US006497462B2

(12) United States Patent
Jackson

(10) Patent No.: US 6,497,462 B2
(45) Date of Patent: Dec. 24, 2002

(54) SELF-ADJUSTING CAM LOCK FOR STORAGE CABINET

(75) Inventor: Jeremy J. Jackson, Big Rapids, MI (US)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 09/761,990

(22) Filed: Jan. 16, 2001

(65) Prior Publication Data

US 2002/0093274 A1 Jul. 18, 2002

(51) Int. Cl.[7] ..... E05B 63/00

(52) U.S. Cl. ..... 312/215; 70/78; 312/107.5

(58) Field of Search ..... 312/107.5, 219, 312/216, 221, 215; 292/350, DIG. 57, 351, DIG. 62; 70/379 R, 380, DIG. 42, 78

(56) References Cited

U.S. PATENT DOCUMENTS

| | | | | |
|---|---|---|---|---|
| 912,570 A | | 2/1909 | Holland | |
| 1,109,086 A | * | 9/1914 | Stuck | 312/107.5 |
| 1,164,724 A | | 12/1915 | Kilmer | |
| 1,574,712 A | | 2/1926 | Stone | |
| 2,750,901 A | | 6/1956 | McClellan | |
| 2,793,927 A | | 5/1957 | Reitzel | |
| 2,810,616 A | | 10/1957 | McClellan | |
| 3,575,482 A | | 4/1971 | MacMaster et al. | |
| 3,597,036 A | | 8/1971 | Buffington | |
| 3,674,360 A | | 7/1972 | Ratner | |
| 3,870,387 A | | 3/1975 | Mortashed | |
| 4,168,103 A | | 9/1979 | Hagen | |
| 4,202,587 A | | 5/1980 | Wieland | |
| 4,605,266 A | | 8/1986 | McKernan et al. | |
| 5,249,443 A | | 10/1993 | Anderson | |
| 5,257,860 A | | 11/1993 | Slivon | |
| 5,303,994 A | | 4/1994 | Elsholz | |
| 5,385,039 A | | 1/1995 | Feldpausch et al. | |
| 5,678,437 A | | 10/1997 | Walla | |
| 6,018,969 A | | 2/2000 | Haseley et al. | |

FOREIGN PATENT DOCUMENTS

| | | |
|---|---|---|
| FR | 85 09302 | 12/1986 |

* cited by examiner

*Primary Examiner*—John G. Weiss
*Assistant Examiner*—Michael J. Fisher
(74) *Attorney, Agent, or Firm*—Flynn, Thiel, Boutell & Tanis, P.C.

(57) ABSTRACT

An upright storage cabinet having a cam lock arrangement which simultaneously locks all of the cabinet drawers. The lock arrangement includes a rotatable cam member which is movable into a locked position wherein the cam member engages a locking element to lift a lock bar into engagement with the drawers, and an unlocked position wherein the cam member disengages from the locking element to disengage the lock bar from the drawers. The cam member is mounted for vertical displacement relative to an actuator of the lock arrangement to allow self-adjustment of the position of the cam member relative to the locking element.

27 Claims, 9 Drawing Sheets

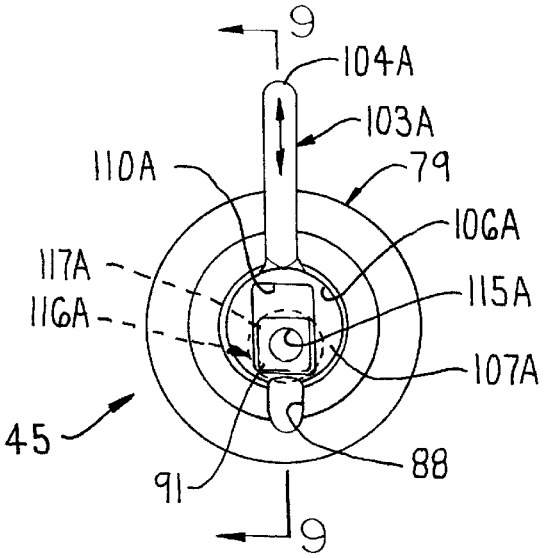
FIG. 8
FIG. 9
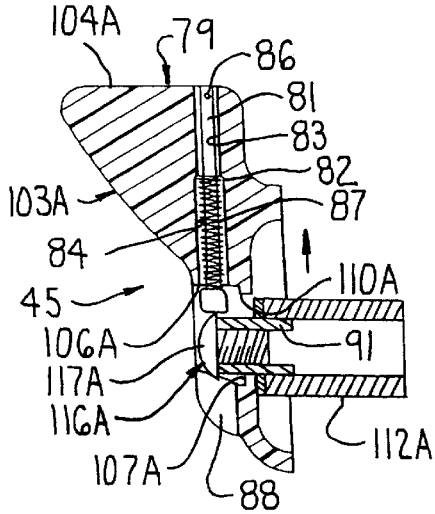
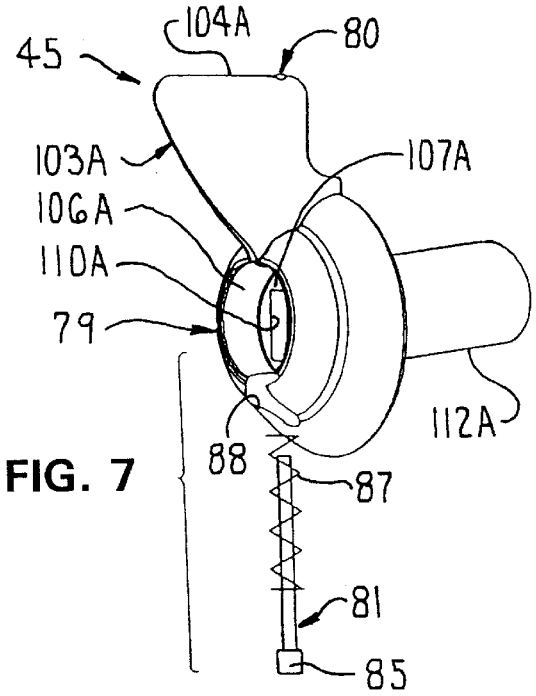
FIG. 7
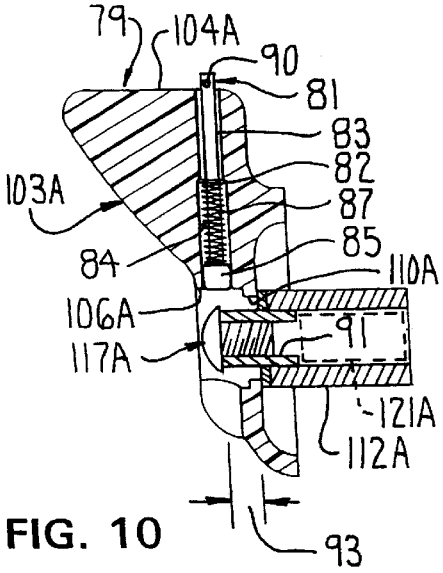
FIG. 10

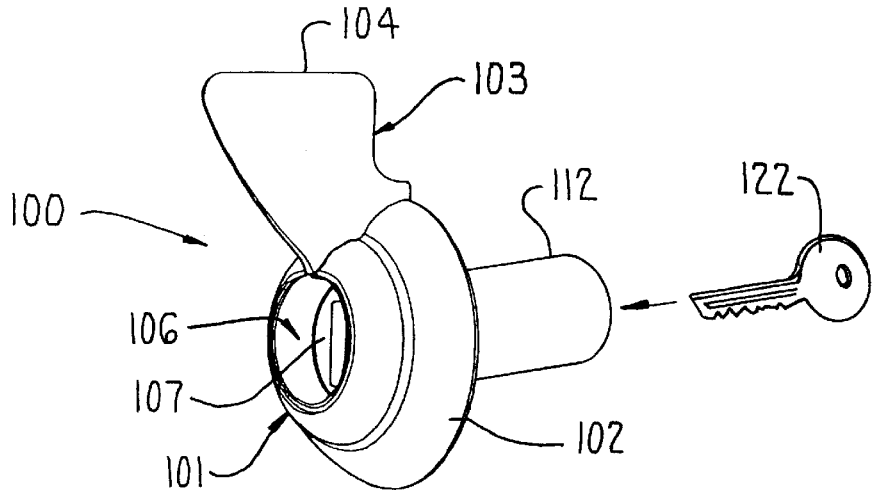
FIG. 15 (PRIOR ART)
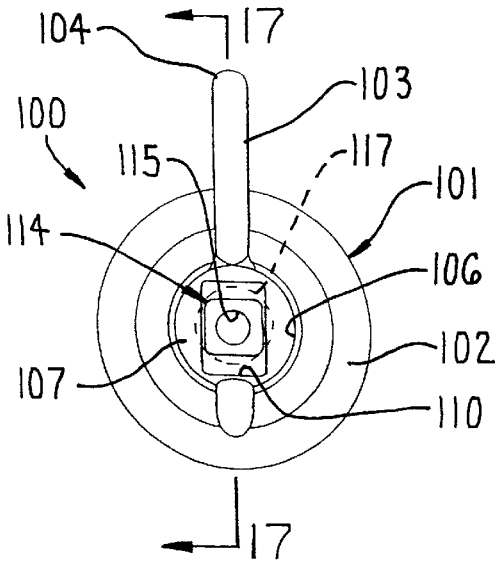
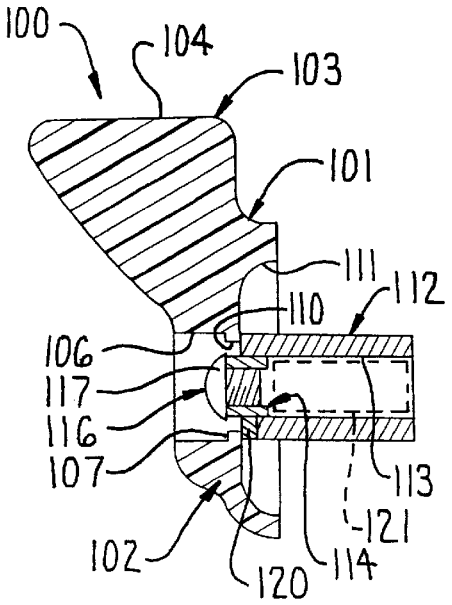
FIG. 16 (PRIOR ART) FIG. 17 (PRIOR ART)

SELF-ADJUSTING CAM LOCK FOR STORAGE CABINET

FIELD OF THE INVENTION

This invention relates to an upright storage cabinet and more particularly, an upright storage cabinet having a self-adjusting cam lock for locking the drawers of the cabinet.

BACKGROUND OF THE INVENTION

Upright storage cabinets, as used in offices and similar environments, conventionally include an upright hollow housing which is open at the front so as to receive a plurality of file drawers therein in a vertically stacked arrangement. Such cabinets are well known and typically include a locking mechanism so as to securely lock the drawers in a closed position. These locking mechanisms employ a key-operated lock device which is mounted so as to be accessible from a front side of the housing, which lock device acts through a suitable intermediate linkage for controlling a vertical lock bar which is disposed adjacent one of the corners of the housing. The lock bar is in turn provided with locking elements which cooperate with the individual drawers so as to simultaneously lock them in the closed position. Some conventional cabinets are provided with locking mechanisms including a cam member which is rotated or otherwise actuated to vertically manipulate the lock bar to bring same into locking engagement with the drawers. One example of such a cabinet and locking mechanism is the commercially available PREMISE® pedestal storage unit sold by the assignee of the instant invention having a family code number of FS49DPFN.

The cam member of the above PREMISE® pedestal unit as illustrated in FIGS. 15–17 herein includes a cam lock assembly 100 which is mounted adjacent the rearwardly facing side of a front wall of the topmost drawer. The cam lock assembly 100 includes a cam member 101 having a generally hemispherically-shaped main body 102. Main body 102 mounts thereon a generally fin-shaped cam 103 which projects sidewardly from an outer surface of main body 102 and terminates in a straight edge 104. The rearwardly facing side of main body 102 defines a circular opening 106 therein which projects into main body 102 and terminates at a flat base wall 107. As shown in FIG. 16, base wall 107 defines therein a vertically-elongate rectangular slot 110 which communicates with a circular recess 111 defined in the frontwardly facing side of main body 102.

Cam lock assembly 100 additionally includes a cylindrically shaped lock shell 112 which is non-rotatably mounted on the front upright wall of a cabinet drawer. Lock shell 112 defines a forwardly opening receptacle 113 for a plug-type actuator 121 (shown schematically in FIG. 17 in dotted lines) which is operable by a key to lock and unlock the cam lock assembly 100. A lock insert or lug 114 is mounted for rotation within lock shell 112, and includes an internally threaded hole 115 for receiving a pinch bolt or screw 116. Screw 116 is engaged within the threaded hole 115 so that the screw head 117 thereof is oriented within opening 106 of main body 102. When the screw 116 is fully tightened within hole 115, the screw head 117 clamps against the base wall 107 along the longitudinal edges thereof. This clamping of the screw head 117 against base wall 107 serves to fix the cam member 101 to the lug 114. The engagement of the lug 114 within slot 110 allows rotation of cam member 101 along with lug 114 when same is actuated as discussed below.

The rotation of the lug 114 relative to the lock shell 112 between the locked and unlocked positions is limited by an annular plate 120 which is nonrotatably fixed to lug 114. Plate 120 defines a peripherally located arcuate recess or inset portion which defines a pair of shoulders (not shown) which are spaced from one another along the circumference of plate 120. The shoulders cooperate with a correspondingly located stop (not shown) which projects outwardly from the rearmost end of lock shell 112. The lug 114 is keyed at a front end thereof for cooperation with the actuator 121. Thus, when locking of the drawers is desirable, a key 122 is inserted into the plug-type actuator 121 and turned. The turning of the key 122 rotates lug 114 and cam member 101 to the locked position as limited by the stop of lock shell 112, causing the fin-shaped cam 103 to rotate upwardly so that the edge 104 thereof makes contact with a horizontal locking bar journalled along the upper and frontmost edge of the cabinet housing. The actuation of the horizontal locking bar by cam 103 in turn raises a vertical locking bar oriented along a side wall of the cabinet. The vertical locking bar includes locking elements which cooperate with the individual drawers to lock same in the closed position.

The cam 103 of the above-described cam lock assembly 100 tends to undergo "creep" over a period of time relative to the lug 114 and the associated screw 116. That is, repeated use of the lock assembly 100, movement of the cabinet, etc., can cause cam member 101 to shift longitudinally from its original installed position relative to lug 114 and screw 116. This shifting of the cam member 101 in turn often results in a misalignment of the fin-shaped cam 103 relative to the horizontal locking bar. The creep of cam 103 from its original position, as set at the time of manufacture and assembly of the cabinet, causes malfunctioning of the lock assembly of the cabinet, which in turn necessitates time consuming and costly readjustment of the position of the cam member 101.

The present invention was developed in order to eliminate or at least minimize the inconveniences caused by creep or shifting of the cam member as discussed above. More specifically, the invention includes a cam lock assembly which permits self-adjustment of the cam member relative to the lug. More specifically, the cam member is provided with a spring-loaded plunger which allows the cam member to float relative to the lug and the associated screw.

Other objects and purposes of the invention, and variations thereof, will be apparent upon reading the following specification and inspecting the accompanying drawings.

BRIEF DESCRIPTION OF THE DRAWINGS

FIG. 7 is an enlarged exploded rear perspective view of the cam lock assembly;

FIG. 8 is an enlarged rear view of the cam lock assembly of FIG. 7 with the plunger in the working or released position inside the cam member;

FIG. 9 is a cross-sectional view taken generally along line 9—9 in FIG. 8 also with the plunger in the working or released position;

FIG. 10 is an enlarged cross-sectional view similar to FIG. 9, but illustrating the plunger in the assembly position;

FIG. 15 is an enlarged rear perspective view of the cam lock assembly of the PREMISE® pedestal unit;

FIG. 16 is an enlarged rear view of the cam lock assembly of FIG. 15; and FIG. 17 is an enlarged cross-sectional view taken generally along line 17—17 in FIG. 16.

Figure 1:
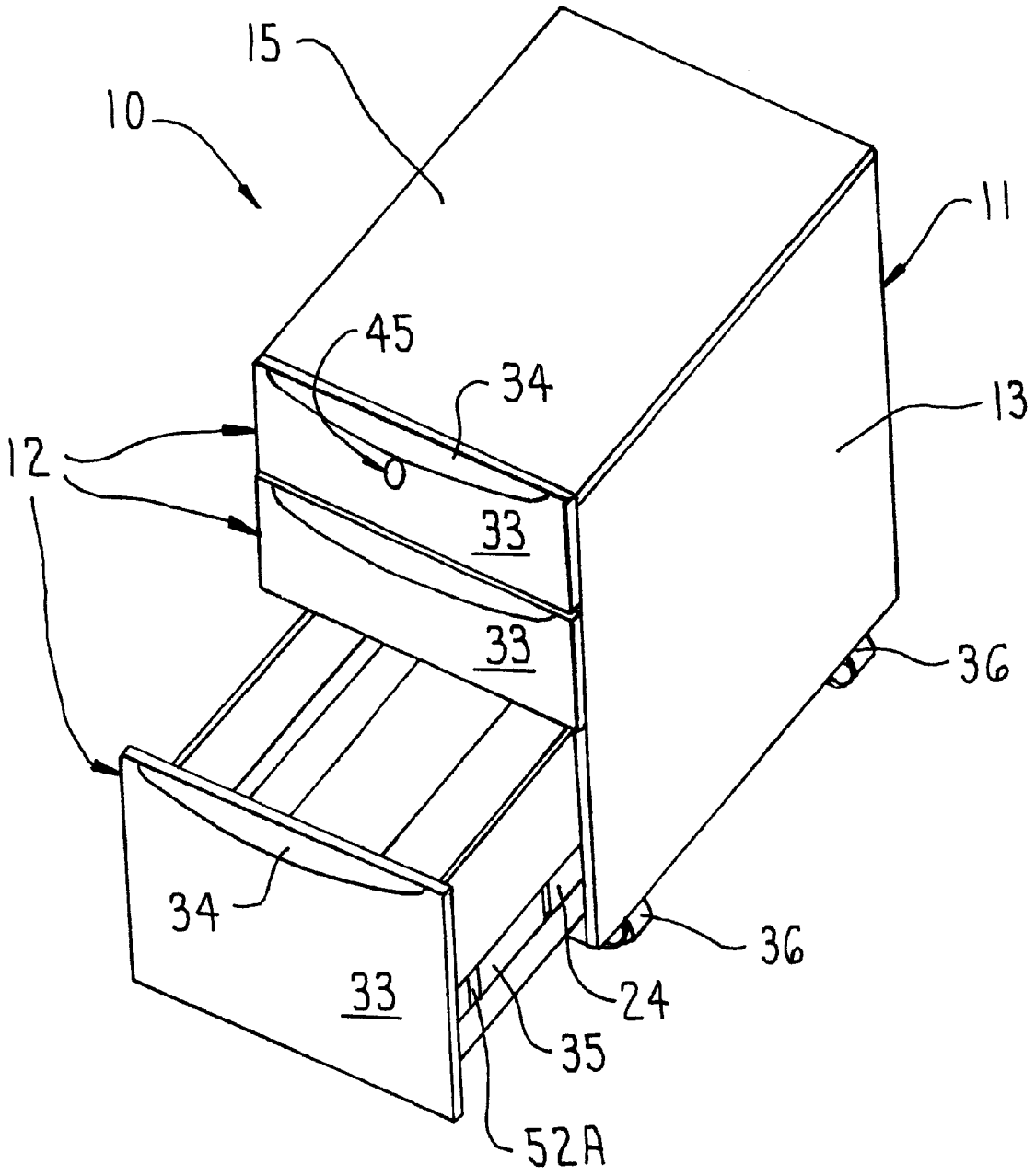
FIG. 1 is a front perspective view of an upright storage cabinet according to the invention with one drawer in an open position.

Certain terminology will be used in the following description for convenience in reference only, and will not be limiting. For example, the words "upwardly", "downwardly", "rightwardly" and "leftwardly" will refer to directions in the drawings to which reference is made. Further, the words "frontwardly" and "rearwardly" will respectively refer to the side of the storage cabinet which normally faces the user and the side of the cabinet which normally faces away from the user. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

FIG. 1 illustrates an upright storage cabinet 10 according to the invention. The storage cabinet 10 includes a box-like cabinet housing or enclosure 11 that has an open front side, and a plurality of slidable drawers 12 which are slidably received through the open front side of the cabinet 10. The cabinet housing 11 is generally formed from a pair of identical right and left side walls 13, a back wall 14, and a top wall 15. The side walls 13, back wall 14, and top wall 15 are supported on an open, box-like frame 16.

Frame 16 includes a pair of horizontally-spaced and generally parallel upright front frame members 20 and a pair of horizontally-spaced and generally parallel upright rear frame members 21. The respective front frame members 20 are connected to one another by upper and lower vertically spaced and generally parallel horizontal frame members 22. The rear frame members 21 are interconnected to one another in a similar manner. In the illustrated embodiment, the adjacent pairs of front and rear upright frame members 20 and 21 are fixed to the inner sides of the respective right and left side walls 13. The horizontal frame members 22 extend transversely between the right and left side walls 13 and are vertically positioned with respect thereto via flanges 23 formed on the upper and lower edges of side walls 13. To mount the drawers 12 within the cabinet 10, a plurality of elongate drawer slides 24 (not shown in FIG. 2, but see FIG. 1) are mounted along each of the side walls 13 so that the slides 24 extend horizontally between the front and rear upright frame members 20 and 21. For this purpose, the respective frame members 20 and 21 each define therein a plurality of connector tabs 25 which are adapted to engage the respective drawer slides 24.

Each of the drawers 12 includes a pair of identical side walls 30, a bottom wall 31, a back wall 32, and a front wall 33 which mounts thereon a drawer pull 34. The respective side walls 30 of each drawer 12 define outwardly projecting, generally horizontally oriented reinforcing channels 35 which seat on the respective opposed drawer slides 24 mounted on the right and left side walls 13 of the cabinet 10. In this regard, channels 35 define pockets and tabs therein which snap lockingly engage the drawer slide 24 so as to prevent dislodgement of the drawer 12 therefrom. The mounting of drawer slides 24 on side walls 13 as mentioned above, as well as the supporting of the drawers 12 on the opposed pairs of slides 24 by pockets and tabs, are conventional and thus a more detailed description is not believed necessary.

Figure 2:
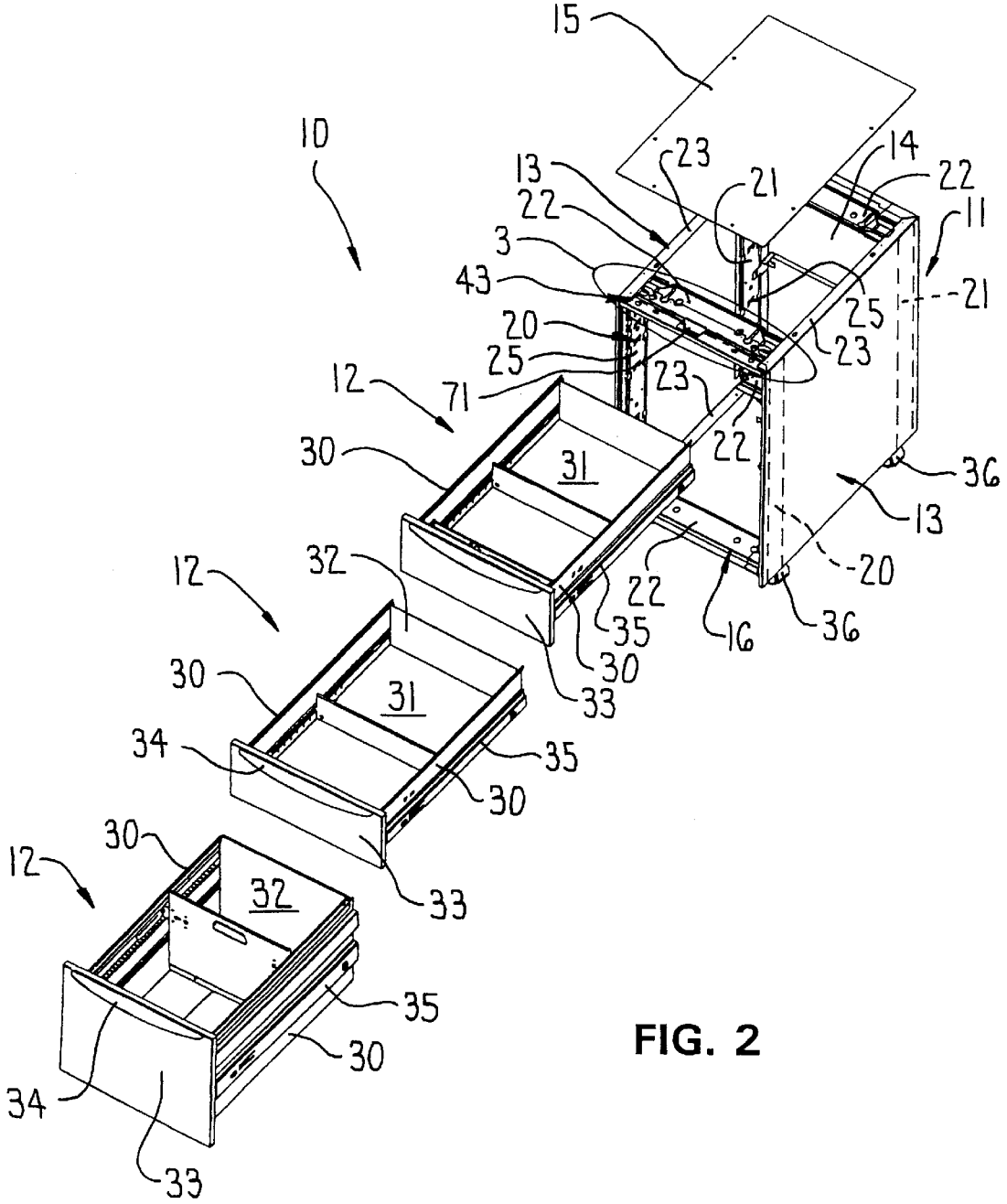
FIG. 2 is an exploded perspective view of the storage cabinet illustrated with the drawers and top wall of the cabinet removed.

As shown in FIGS. 1 and 2, front and rear pairs of castors 36 are mounted to the respective front and rear lower horizontal frame members 22 to enable easy movement of the storage cabinet 10 to a desired location.

The storage cabinet 10 is provided with a locking arrangement 40 which permits simultaneous locking of all of the cabinet drawers 12 as is conventional with storage arrangements of this type. The locking arrangement 40 generally includes rigid vertical and horizontal locking bars 41 and 42, a plate-like cross member 43 which defines a guide channel 44 for the horizontal locking bar 42, and a cam lock assembly 45. In the illustrated embodiment, the cam lock assembly 45 is mounted on the rearwardly facing side of the the front wall 33 of the uppermost drawer 12.

Figure 3:
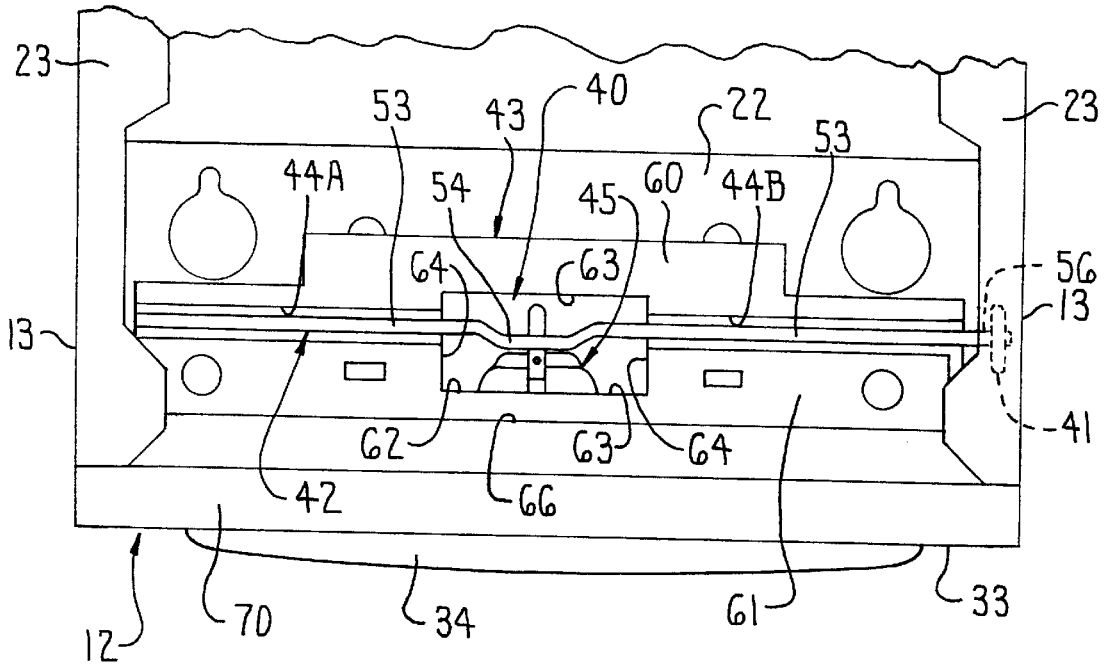
FIG. 3 is a fragmentary enlarged overhead view of the storage cabinet of FIG. 2 illustrating the cam member and horizontal lock bar.
Figure 4:
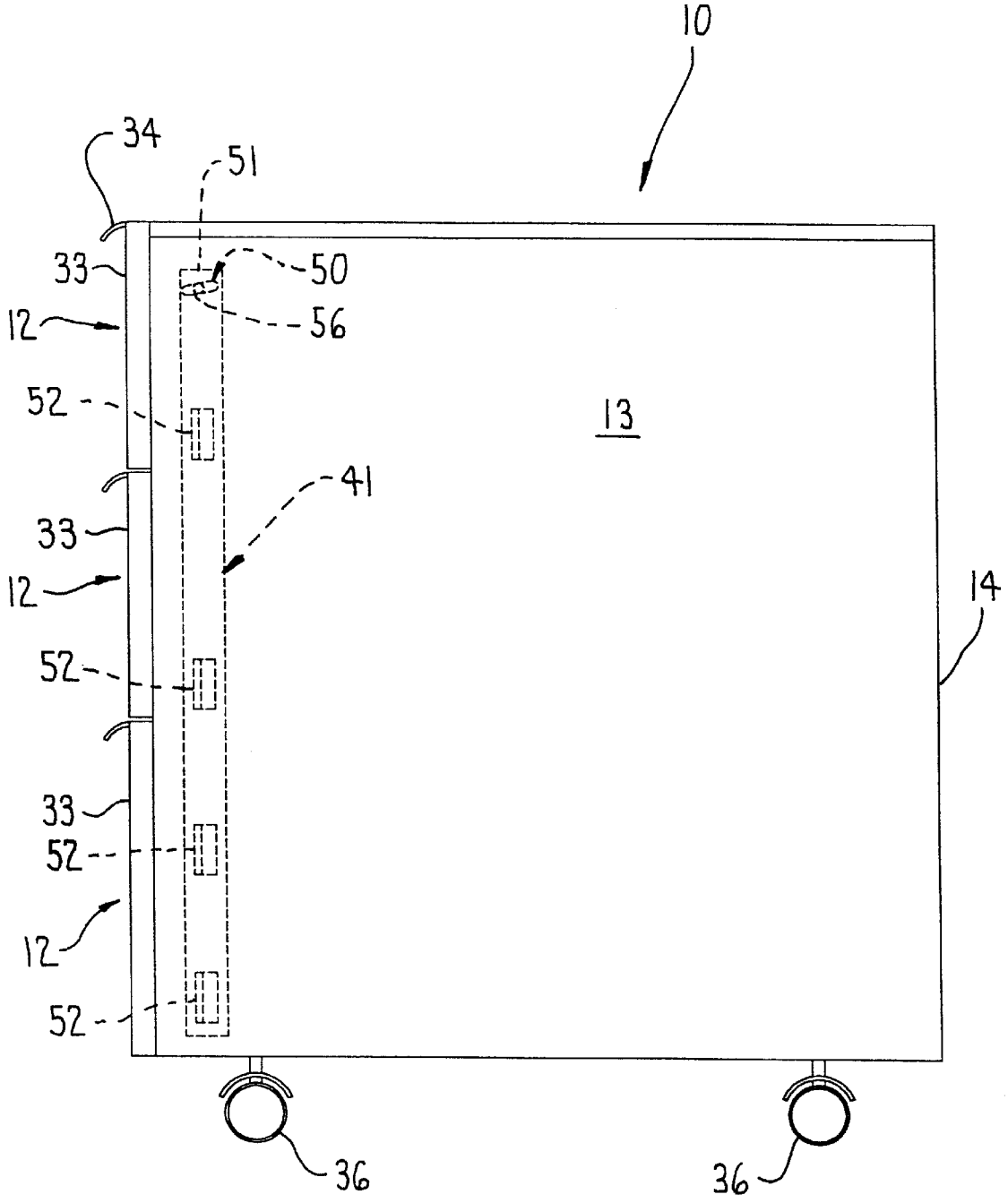
FIG. 4 is an enlarged diagrammatical side view of the storage cabinet illustrating the vertical lock bar in broken lines.

As shown in FIGS. 3 and 4, the vertical locking bar 41 is mounted inside the cabinet 10 generally along the front edge of the right side wall 13. In the illustrated embodiment, the locking bar 41 is disposed between the right front frame member 20 and the right side wall 13 of the housing 11. The locking bar 41 is mounted so that same is horizontally fixed, but vertically slidably movable between a locked position wherein the bar 41 is positioned in its uppermost position relative to side wall 13, and an unlocked position wherein the bar 41 is in its lowermost position relative to side wall 13. The locking bar 41 is vertically elongate and defines therein a horizontally elongate slot 50 which is disposed closely adjacent an uppermost horizontal edge 51 thereof. The slot 50 is oriented at a slight angle relative to the horizontal, and in this regard angles upwardly as same projects in a front-to-back direction of the cabinet 10. The locking bar 41 includes a plurality of tabs or flanges 52 which project inwardly towards the interior of the cabinet 10 in a generally perpendicular manner relative to side wall 13. These flanges 52 can be formed by cut-outs in which the cut metal material is then bent inwardly to form the flanges 52. The flanges 52 are vertically spaced from one another along the vertical length of the bar 41, and are located in positions which allow same to cooperate with correspondingly located notches 52A (FIG. 1) defined in the individual drawers 12 to lock same within the cabinet 10.

Figure 5:
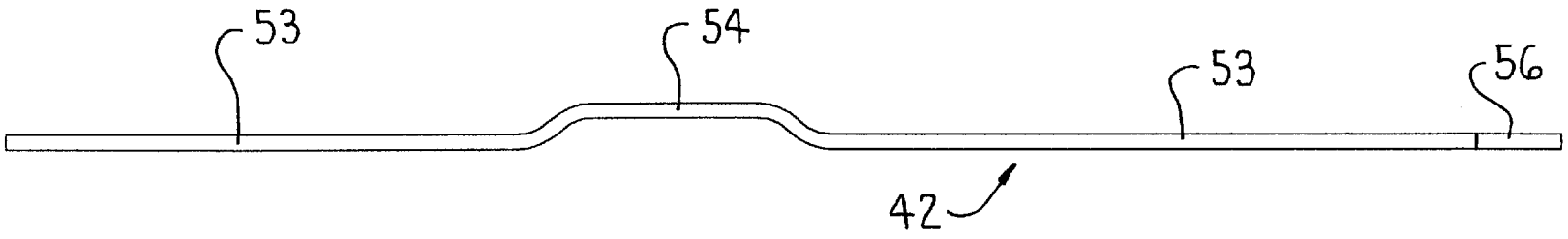
FIG. 5 is an enlarged side view of the horizontal lock bar in isolation.
Figure 6:
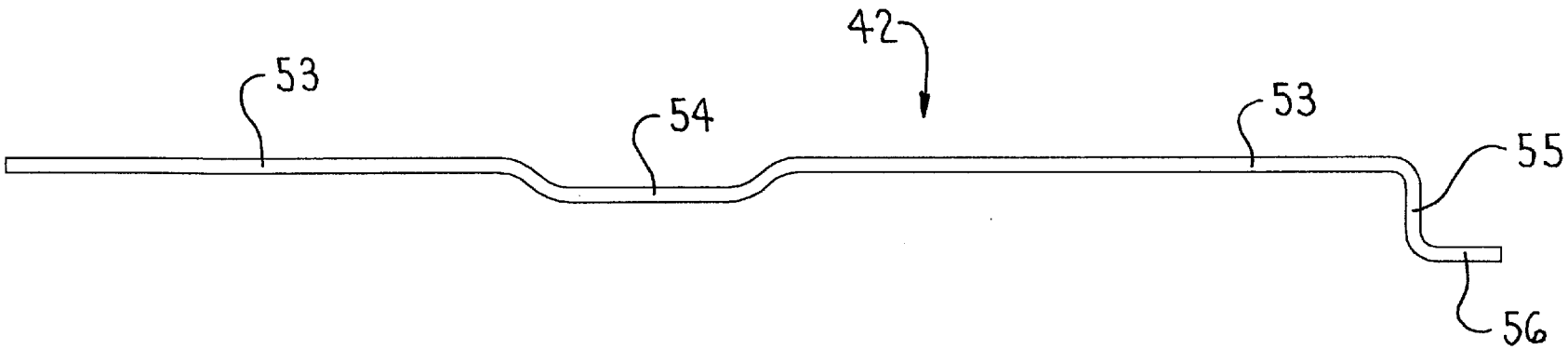
FIG. 6 is a view of the horizontal lock bar rotated approximately 90° from the position illustrated in FIG. 5.
Figure 13:
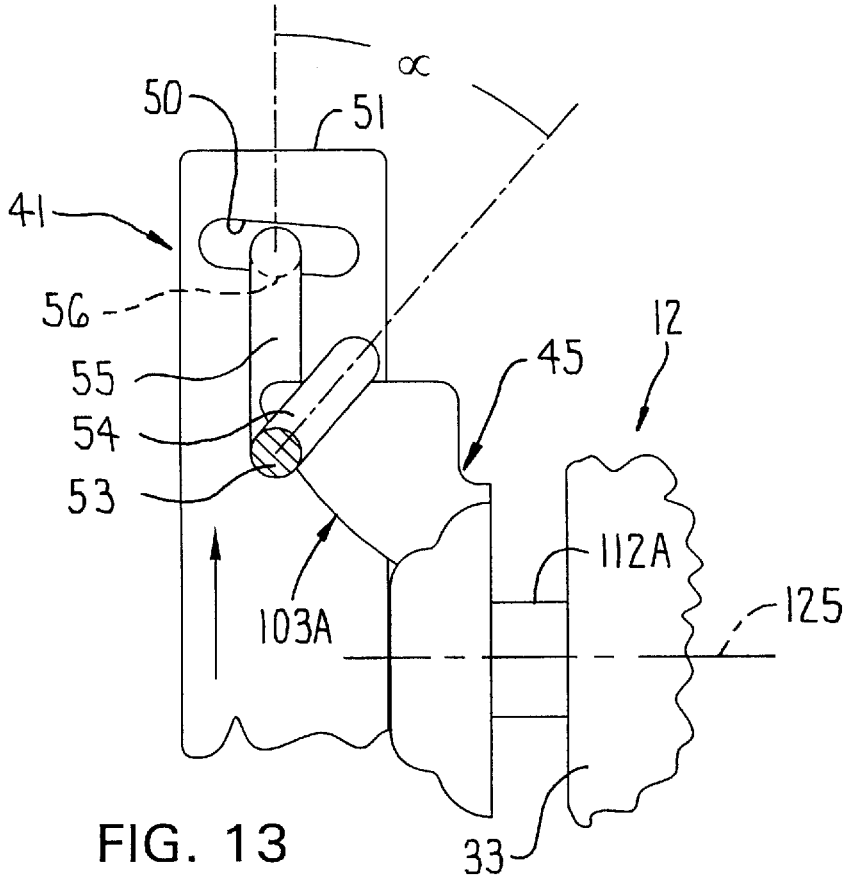
FIG. 13 is an enlarged fragmentary diagrammatical side view of the locking mechanism with the cam member in the locked position.
Figure 14:
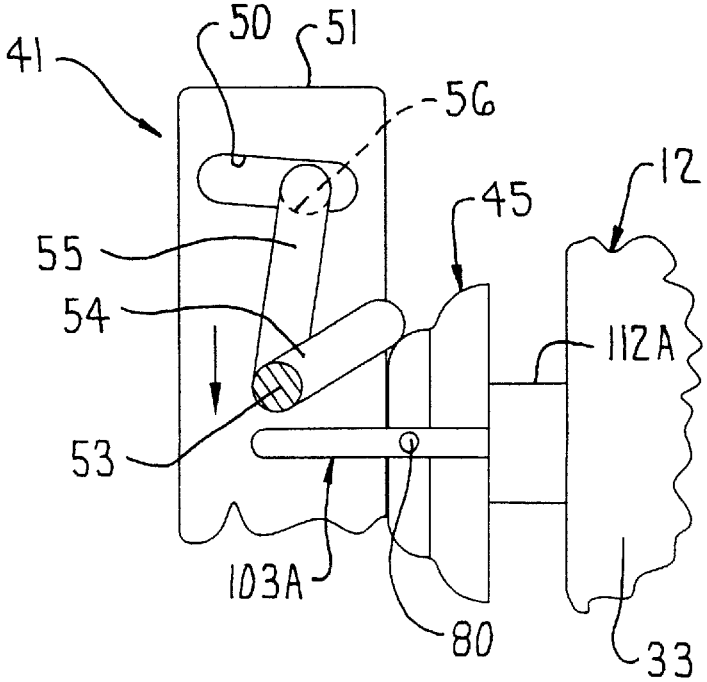
FIG. 14 is an enlarged fragmentary diagrammatical side view similar to FIG. 13, but illustrating the cam member in the unlocked position.

With reference to FIGS. 5 and 6, the rod-like horizontal locking bar 42 includes a pair of straight portions 53 which are disposed on opposite sides of a generally centrally located actuator portion 54 which is offset relative to straight portions 53. The rightmost end of locking bar 42 is bent so as to form a first leg 55 which projects generally vertically relative to the right portion 53 and a second leg 56 which is joined to an outermost end of first leg 55 and projects generally horizontally therefrom so that the first and second legs 55 and 56 are perpendicular relative to one another. As discussed further below, the terminal end of the second leg 56 is engaged within the slot 50 of the vertical locking bar 41 mounted within cabinet 10. As shown in FIGS. 13 and 14, the vertical first leg 55 of bar 42 and the actuator portion 54 are disposed at an angle a relative to one another, and in the illustrated embodiment, angle a has a value of about 45°.

Figure 11:
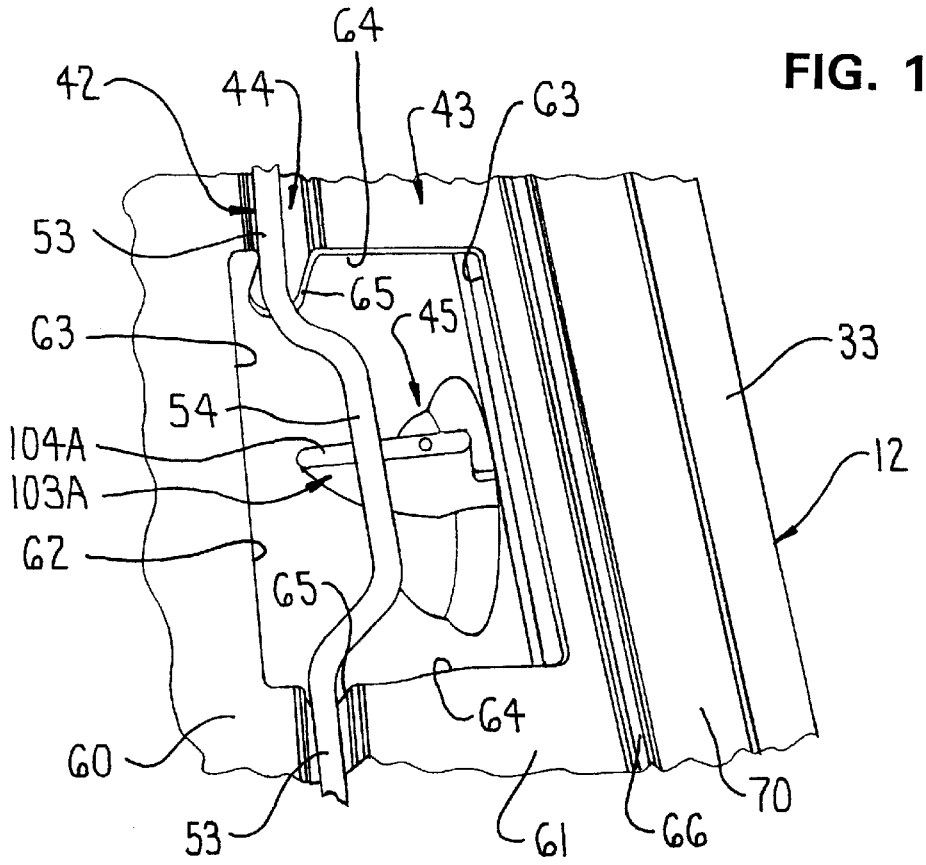
FIG. 11 is an enlarged fragmentary overhead view of the locking mechanism with the cam member in the raised locked position.
Figure 12:
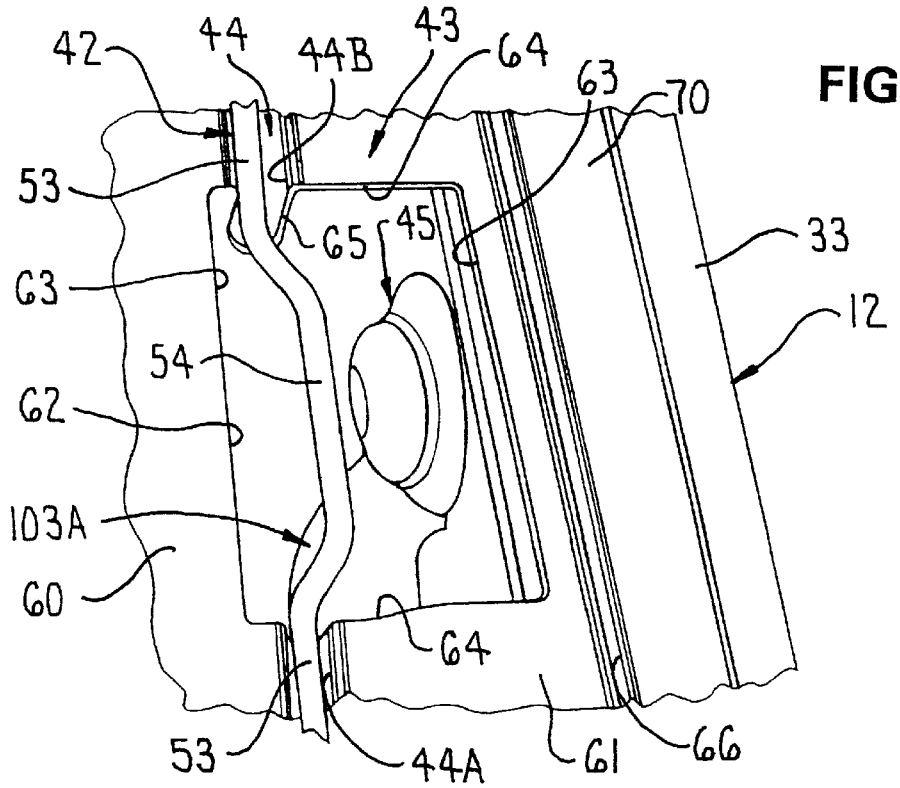
FIG. 12 is an enlarged fragmentary view similar to FIG. 11, but illustrating the cam member in the lower unlocked position.

The horizontal locking bar 42 is journalled in the guide channel 44 of cross member 43. With reference to FIGS. 3, 11 and 12, cross member 43 is superimposed upon and fixed to the frontmost and upper horizontal frame member 22. Cross member 43 in the illustrated embodiment has a pair of flat, plate-like and coplanar parts 60 and 61 disposed on opposite sides of guide channel 44. A rectangular window or cut-out 62 is defined within cross member 43 and interrupts and divides the guide channel 44 into two longitudinally aligned channel parts 44A and 44B. Window 62 has a pair of straight longitudinal edges 63 which are parallel to, and spaced a short distance outwardly from guide channel 44, and a pair of straight transverse edges 64 which extend between the edges 63 and respectively form inner terminal U-shaped end edges 65 of guide channel 44. Guide channel 44 thus has an upwardly-opening U-shape when viewed in transverse cross-section, and projects downwardly from the horizontal plane occupied by parts 60 and 61. Cross member 43 is further defined by a wall or shoulder 66 which projects vertically upwardly from frontmost part 61, and a frontwardly oriented flat portion 70 which projects horizontally forwardly from the uppermost end of wall 66. A flange 71 (FIG. 2) projects downwardly from a longitudinal forward edge of portion 70 and is disposed closely adjacent the front wall 33 of the drawer 30 when same is in the closed position.

Horizontal locking bar 42 is positioned within guide channel 44 so that the actuator portion 54 thereof is disposed within window 62 to allow same to move freely between the locked and unlocked positions, and the straight rod-like portions 53 of bar 42 are seated upon the upwardly facing lowermost surfaces of the channel portions 44A and 44B. Thus, with the second leg 56 of the bar 42 engaged within the slot 50 of vertical locking bar 41, the channel 44 serves to journal the locking bar 42 so that same can be rotated between locked and unlocked positions.

The above-discussed construction of the storage cabinet 10 is conventional, and the advantageous construction of the cam lock assembly 45 according to the invention will now be described. The cam lock assembly 45 is similar in construction to the cam lock assembly 100 discussed above, and therefore the same reference numbers plus an "A" are utilized to depict identical or similar components. With reference to FIGS. 7–9, the cam lock assembly 45 according to the invention includes a cam member 79 similar to cam member 101 discussed above, except that cam member 79 defines therein a stepped bore 80 which receives an elongate plunger 81. In the illustrated embodiment, cam member 79 and plunger 81 are constructed of a rigid plastic. Bore 80 extends from the terminal straight edge 104A of cam 103A to the circular opening 106A for communication therewith, and defines a shoulder 82 approximately midway along the longitudinal extent thereof. Shoulder 82 divides the bore 80 into two portions 83 and 84 of different diameter, and portion 83 disposed adjacent the straight edge 104A of cam member 79 has the smaller diameter. Plunger 81 has a rod-like shape, and at a terminal end thereof defines an enlarged plunger head 85. The diameter of plunger head 85 is similar to, but slightly smaller than, the diameter of bore portion 84 to allow sliding reciprocating movement of plunger head 85 therein. The end of plunger 81 opposite plunger head 85 defines therein a through hole 86, and a compression spring 87 is coaxially arranged about the plunger 81 and seats within bore portion 84 and against shoulder 82. Cam member 79 additionally defines a sidewardly-opening recess 88 on a side thereof opposite cam 103A, which recess 88 is aligned longitudinally with the bore 80.

With reference to FIG. 7, plunger 80 is assembled to cam member 79 as follows. The end of plunger 80 opposite head 85 is inserted into the spring 87, and this end of plunger 80 and spring 87 are then inserted into recess 88 of cam member 79 and into bore portion 84 until the spring 87 abuts shoulder 82. The plunger head 85 is then pushed into bore portion 84 thereby compressing the spring 87 against shoulder 82 until the opposite terminal end of plunger 80 emerges from the bore portion 83 and the hole 86 is exposed. An assembly pin 90 is then inserted into hole 86. Assembly pin 90 is oriented transversely across cam 103A and is biased against the edge 104A thereof to hold the plunger 80 in the assembly position illustrated in FIG. 10.

The cam lock assembly 45 additionally includes a lock insert or lug 91 which is similar to lug 114, but has a greater length so as to project further into opening 106A of cam member 79 as compared to the lug 114 shown in FIG. 17. The length of lug 91 is made longer so that the head 117A of the pinch bolt or screw 116A when tightened within hole 115A does not clamp against the longitudinal edges of base wall 107A since a clearance 93 is defined between the screw head 117A and the base wall 107A. Once the screw 116A is tightened within hole 115A, the assembly pin 90 is removed to allow the plunger to move into opening 106A and against screw head 117A under the biasing force of spring 87 as illustrated in FIG. 9. The spring 87 exerts a force on cam member 79 to urge same in a direction away from lug 91 and screw 116A as indicated by the arrow in FIG. 9. The result is that cam member 79 "floats" relative to lug 91, since lug 91 is engaged within slot 110A and is of a dimension which allows the cam member 79 to undergo reciprocating movement (see the arrows in FIG. 8) so that slot 110A is moved longitudinally relative to lug 91, which lug 91 is rotatably movable, but otherwise fixed relative to the drawer front 33. More specifically, lug 91 has a width dimension which is similar to, but slightly less than the width dimension of slot 110A as defined between the two longitudinal edges thereof which allows cam member 79 to slide relative to lug 91 and screw 116A. The cam member 79 is thus vertically shiftable relative to lug 91 in a direction perpendicular with respect to the rotational axis 125 of cam member 79.

With reference to FIGS. 11–14, the cam lock assembly 45 according to the invention is installed on the front wall 33 of the topmost drawer 12 so that the cam 103A of cam member 79 is oriented generally horizontally in the unlocked position (FIGS. 12 and 14), and generally vertically in the locked position (FIGS. 11 and 13).

In operation, when it is desirable to lock all of the drawers 12 of the storage cabinet 10 according to the invention, the user inserts a key into the actuator (not shown) of cam lock assembly 45 and turns the key clockwise to cause rotation of the cam 103A in a clockwise direction. As the cam 103A translates upwardly, the free edge 104A thereof engages the actuator portion 54 of horizontal locking bar 42 and lifts same upwardly causing rotation of locking bar 42 relative to and within guide channel 44. This upward lifting of the actuator portion 54 and rotation of locking bar 42 and the second leg 56 thereof applies an upwardly directed force on vertical locking bar 41 to lift same into its uppermost position relative to side wall 13, so that the flanges 52 thereof engage within correspondingly located recesses defined in the individual drawers 12. The engagement of the flanges 52 of locking bar 41 with the drawers 12 prevents same from being opened.

To unlock the drawers 12, the user turns the key in a counterclockwise direction, which causes rotation of the cam 103A counterclockwise. As the cam 103A translates downwardly, the free edge 104A thereof disengages with the actuator portion 54 of locking bar 42, and the vertical locking bar 41 under its own weight returns to the unlocked or lowermost position to disengage the flanges 52 from the drawers 12 and allow same to be opened.

The ability of the cam member 79 to float relative to the lug 91 and screw 116A avoids the need for readjustment of the position of cam member 79 relative to the horizontal locking bar 42. In this regard, the spring 87 in the released position of FIGS. 8 and 9 normally biases the cam member 79 so that the lug 91 is in a lowermost position (or bottomed out) within slot 110A as shown. As such, when the cam 103A is rotated into the locking position, the vertical force applied to cam 103A by actuator portion 54 of locking bar 42 causes the cam member 79 to shift slightly downwardly relative to lug 91. When the cam member 79 is returned to the unlocked position, the cam member 79 automatically adjusts to the bottomed out position under the action of the spring 87. Accordingly, the cam lock assembly 100 pursuant to the present invention self-adjusts every time the cam member 79 is moved into the unlocked position, which avoids the need for positional readjustment of the cam member 79.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. In a storage cabinet having a frame, said frame supporting first and second upright side walls in laterally spaced relation with one another, a generally upright rear wall extending laterally between respective upright rear edges of said first and second side walls, and a generally horizontally oriented top wall extending laterally between respective upper edges of said first and second side walls, said rear, side and top walls together defining a hollow interior which opens forwardly through a front end of said cabinet, at least one drawer being slidably mounted within said front end and being movable between a closed position wherein said drawer is disposed within said hollow interior and an open position wherein said drawer projects outwardly from said front end, a locking arrangement for locking said drawer in said closed position, said locking arrangement including a generally horizontally oriented first locking bar mounted for rotation adjacent said top wall, a generally vertically oriented second locking bar connected to said first locking bar and mounted for reciprocating vertical movement relative to said drawer adjacent one of said side walls, and a lock mounted on a front wall of said drawer, said first locking bar defining an actuator portion for cooperation with said lock, said lock including a lug element rotatably mounted on said drawer front and mounting thereon a cam member which is movable between a locked position wherein said cam member engages said actuator portion of said first locking bar to move said second locking bar into engagement with said drawer and lock same in said closed position, and an unlocked position wherein said cam member is disengaged from said actuator portion and said second locking bar is disengaged from said drawer, comprising the improvement wherein said cam member is mounted for sliding movement relative to said lug element to effect automatic re-adjustment of a position of said cam member relative to said actuator portion during movement of said cam member between said locked and unlocked positions.

2. The storage cabinet of claim 1 wherein said lock defines a generally horizontally oriented axis which is transversely oriented relative to an axis of rotation of said first locking bar, said cam member being rotatable about said axis of said lock between said locked and unlocked positions and being slidably movable relative to said lug element in a direction which is perpendicular to said axis of said lock.

3. The storage cabinet of claim 2 wherein said second locking bar defines a slot at an upper end thereof, said first locking bar having a terminal end engaged within said slot such that upon rotation of said first locking bar by said cam member said terminal end translates upwardly and lifts said vertical locking bar into engagement with said drawer to lock same in said closed position.

4. The storage cabinet of claim 1 wherein said lock includes a biasing member disposed to normally urge said cam member in a first direction into a first position relative to said lug element, said cam member moving in a second direction which is opposite the first direction into a second position relative to said lug element upon engagement with said actuator portion and returning to said first position upon disengagement with said actuator portion.

5. The storage cabinet of claim 4 wherein said cam member defines a slot therein in which said lug element is disposed, said slot permitting sliding movement of said cam member relative to said lug element under the action of said biasing member.

6. The storage cabinet of claim 5 wherein a fastening member extends through said slot and is threadingly engaged within said lug element to fasten said cam member thereto, said cam member defining a bore therein in which an elongate plunger is slidably disposed, said plunger defining a terminal end positioned closely adjacent an enlarged head of said fastening member, said biasing member urging said terminal end into contact with said enlarged head to maintain said cam member in said first position.

7. The storage cabinet of claim 6 wherein said cam member includes a flat base wall in which said slot is defined, said base wall having a generally upright surface which faces away from said front wall of said drawer, said enlarged head of said fastening member being horizontally spaced from said base wall to allow sliding movement of said cam member relative to said lug element.

8. The storage cabinet of claim 7 wherein said plunger defines an enlarged head at said terminal end thereof and said bore is stepped so as to define a shoulder located approximately midway along the length thereof, said biasing member comprising a compression spring disposed about said plunger and extending between said shoulder and said enlarged head of said plunger such that said lug element is disposed in an end of said slot which is remote from said enlarged plunger head.

9. The storage cabinet of claim 3 wherein when said cam member is in said first position said lug element is disposed closely adjacent a terminal edge of said slot, and when said cam member is in said second position said lug element is spaced from said terminal edge.

10. A storage cabinet comprising:

a support frame;

a pair of vertically enlarged and generally upright side walls disposed on said support frame in sidewardly spaced relation with one another, a vertically enlarged and generally upright rear wall extending transversely between and interconnecting said side walls, and a horizontally enlarged top wall interconnecting said side and rear walls, said side, rear and top walls together defining a hollow interior of said cabinet which opens forwardly through an open front end of said cabinet;

a drawer mounted within said open front end of said cabinet, said drawer being slidably movable between a closed position within said hollow interior and an open position wherein said drawer is cantilevered outwardly from said open front end; and a locking arrangement for locking said drawer in said closed position, said arrangement including an elongate locking rod mounted on said cabinet adjacent said front wall of said drawer when in said closed position and an elongate locking bar engaged with said locking rod and mounted for slidable vertical movement adjacent one of said side walls for cooperation with said drawer, a cam member which is rotatable between a locked position wherein said cam member engages said locking rod and actuates same to vertically displace said locking bar into locking engagement with said drawer, and an unlocked position wherein said cam member disengages from said locking rod to disengage said locking bar from said drawer, an actuator rotatably mounted on said drawer, said cam member being mounted on said actuator for rotational movement therewith but being displaceable relative thereto under the action of a biasing member, wherein displacement of said cam member relative to said actuator allows positional self-adjustment of said cam to prevent misalignment of said cam member with respect to said locking rod.

11. The storage cabinet of claim 10 wherein said biasing member is disposed to normally urge said cam member in a first direction into a first position relative to said actuator and movement of said cam member into said locked position causes said cam member to displace from said first position into a second position against the action of said biasing member upon engagement with said locking rod, said cam member automatically returning to said first position upon disengagement of same with said locking rod when said cam member is moved into said unlocked position.

12. The storage cabinet of claim 10 wherein said cam member is displaceable in a direction which is generally perpendicular to an axis of rotation of said cam member.

13. The storage cabinet of claim 12 wherein said locking bar is generally vertically oriented and said locking rod is generally horizontally oriented, said locking rod having a terminal end engaged within a slot defined in an upper end of said locking bar such that rotation of said locking rod causes upward translation of said terminal end thereof to effectively lift said locking bar into engagement with said drawer and lock same in said closed position.

14. The storage cabinet of claim 10 further including a plurality of drawers mounted within said open front end of said cabinet in vertically stacked relation, said actuator being mounted on said front wall of an uppermost one of said drawers, and said locking bar being configured to lockingly engage with each of said drawers to simultaneously lock same in said closed position upon said cam member being moved into said locked position.

15. The storage cabinet of claim 10 wherein said cam member defines an elongate and generally rectangular slot therein, said actuator including a rectangular lug projecting into said slot to allow rotation of said cam member along with said actuator, and a threaded fastener extends into said slot and threadably engages said lug to fasten said cam member to said actuator.

16. The storage cabinet of claim 15 wherein said threaded fastener has an enlarged head of a dimension greater than a width of said slot as defined transversely between two longitudinal edges thereof to prevent separation of said cam member from said actuator.

17. The storage cabinet of claim 16 wherein said cam member has a recess which opens rearwardly toward said rear wall of said cabinet and terminates at an upright base wall in which said slot is defined, said base wall defining a flat upright surface which faces rearwardly, said enlarged head of said threaded fastener being disposed within said recess and being horizontally spaced from said surface of said base wall to define a clearance therebetween, said clearance preventing said enlarged fastener head from clamping against said base wall upon tightening of said fastener to allow displacement of said cam member relative to said actuator and said fastener.

18. A furniture component comprising:

a housing defining a generally hollow interior which opens forwardly through an open front end;

a component mounted on said housing for movement between an open position and a closed position wherein said component closes off said open front end; and a locking arrangement including a first locking element supported on said housing and a second locking element connected to said first locking element and mounted for vertical movement relative to said component, a cam member which is rotatable between a locked position wherein said cam member actuates said first locking element to vertically displace said second locking element into locking engagement with said component to lock same in said closed position, and an unlocked position to disengage said second locking element from said component, an actuator rotatably mounted on said component, said cam member being mounted on said actuator for rotation therewith but being movable relative to said actuator such that said cam member self-adjusts its position relative to said first locking element during movement from said locked position to said unlocked position.

19. The furniture component of claim 18 wherein said cam member is movable relative to said actuator in a direction which is perpendicular with respect to an axis of rotation of said cam member.

20. The furniture component of claim 18 wherein said first locking element is an elongate rod which is deformed outwardly along a portion thereof so as to define an actuator portion, said rod being disposed within an elongate channel defined in said housing and having an end spaced from said actuator portion and connected to said second locking element, and said cam member contactingly engages said actuator portion when rotated into said locked position to lift said actuator portion upwardly thereby causing rotation of said rod within said channel such that said end applies an upwardly directed force on said second locking element to vertically displace same into locking engagement with said component.

21. The furniture component of claim 18 wherein said cam member defines a slot therein in which a portion of said actuator is disposed, said slot permitting linear sliding movement of said cam member relative to said actuator under the action of a biasing member.

22. The furniture component of claim 18 wherein said component mounted on said housing is a drawer having a front wall on which said actuator is rotatably mounted, said first locking element being journalled in a channel defined adjacent a top front edge of said housing, and said second locking element is vertically-movably mounted on said housing along an upright side wall thereof.

23. A storage cabinet comprising:

a housing defining a generally hollow interior which opens forwardly through an open front end;

a drawer mounted within said open front end of said housing and being slidably movable between a closed position within said hollow interior and an open position wherein said drawer is cantilevered outwardly from said open front end; and a locking arrangement for locking said drawer and including a cam member which is rotatable between a locked position wherein said cam member engages a portion of said housing and an unlocked position wherein said cam member disengages from said housing portion, and an actuator rotatably mounted on said drawer, said cam member being mounted on said actuator for rotation therewith but being displaceable relative thereto such that said cam member automatically self-adjusts its position relative to said housing portion during movement from said locked position to said unlocked position.

24. The storage cabinet of claim 23 wherein said cam member is movable relative to said actuator in a direction which is perpendicular with respect to an axis of rotation of said cam member.

25. The storage cabinet of claim 23 wherein said portion of said housing comprises a locking rod mounted for rotation within a channel defined in said housing, said locking arrangement further including a locking element connected to an end of said locking rod and mounted on said housing for vertical displacement relative to said drawer, wherein engagement of said cam member with said locking rod causes vertical displacement of said locking element into locking engagement with said drawer to lock same in said closed position.

26. The storage cabinet of claim 25 wherein said cam member defines therein an elongate slot in which a portion of said actuator is disposed, said locking arrangement further including a spring carried on said cam member which normally biases said cam member into a first position relative to said actuator such that said actuator engages a terminal edge of said slot, and engagement of said cam member with said locking rod causes displacement of said cam member relative to said actuator such that said actuator is spaced from said terminal edge.

27. The storage cabinet of claim 26 wherein said locking rod defines an outwardly projecting portion thereon and a terminal end spaced from said projecting portion and connected to said locking element, and said cam member contactingly engages said projecting portion when rotated into said locked position to lift said projecting portion upwardly thereby causing rotation of said locking rod within said channel such that said terminal end applies an upwardly directed force on said locking element to vertically displace same into locking engagement with said drawer.

* * * * *

UNITED STATES PATENT AND TRADEMARK OFFICE

CERTIFICATE OF CORRECTION

PATENT NO. : 6,497,462 B2
DATED : December 24, 2002
INVENTOR(S) : Jeremy J. Jackson It is certified that error appears in the above-identified patent and that said Letters Patent is hereby corrected as shown below:

Column 7,
Lines 65 and 66, change “on said drawer front” to -- on said front wall of said drawer --.

Column 8,
Line 63, change “of claim 3” to -- of claim 5 --.

Column 9,
Line 35, after “cam” insert -- member --.

Signed and Sealed this

Twentieth Day of May, 2003

JAMES E. ROGAN
*Director of the United States Patent and Trademark Office*